US009303639B2

(12) United States Patent
Beling

(10) Patent No.: US 9,303,639 B2
(45) Date of Patent: Apr. 5, 2016

(54) PUMP HAVING A THROTTLE

(75) Inventor: Horst Beling, Heilbronn (DE)

(73) Assignee: Robert Bosch GmbH, Stuttgart (DE)

( * ) Notice: Subject to any disclaimer, the term of this patent is extended or adjusted under 35 U.S.C. 154(b) by 312 days.

(21) Appl. No.: 13/996,746

(22) PCT Filed: Oct. 24, 2011

(86) PCT No.: PCT/EP2011/068566
§ 371 (c)(1),
(2), (4) Date: Sep. 16, 2013

(87) PCT Pub. No.: WO2012/084307
PCT Pub. Date: Jun. 28, 2012

(65) Prior Publication Data

US 2014/0003982 A1 Jan. 2, 2014

(30) Foreign Application Priority Data

Dec. 23, 2010 (DE) ..... 10 2010 064 114

(51) Int. Cl.
*F04B 49/22* (2006.01)
*F04B 1/04* (2006.01)
*F04B 49/24* (2006.01)

(52) U.S. Cl.
CPC ..... *F04B 49/225* (2013.01); *F04B 1/0404* (2013.01); *F04B 1/0452* (2013.01); *F04B 49/24* (2013.01)

(58) Field of Classification Search
CPC .... F04B 1/0404; F04B 1/0452; F04B 49/225; F04B 49/24
See application file for complete search history.

(56) References Cited

U.S. PATENT DOCUMENTS

| | | | | |
|---|---|---|---|---|
| 5,570,720 | A | 11/1996 | Riis | |
| 6,267,040 | B1 * | 7/2001 | Sonoda et al. | 91/420 |
| 2004/0234400 | A1 * | 11/2004 | Schepp et al. | 417/471 |
| 2010/0232998 | A1 * | 9/2010 | Hipp et al. | 417/559 |

FOREIGN PATENT DOCUMENTS

| | | | |
|---|---|---|---|
| CN | 101821138 | A | 9/2010 |
| DE | 29 19 229 | A1 | 11/1980 |
| DE | 37 06 028 | A1 | 9/1987 |
| DE | 100 16 895 | A1 | 10/2001 |
| DE | 10 2005 016 271 | A1 | 11/2006 |
| EP | 0 299 337 | A2 | 1/1989 |
| WO | 03/078840 | A1 | 9/2003 |
| WO | 2009/049987 | A1 | 4/2009 |

OTHER PUBLICATIONS

International Search Report corresponding to PCT Application No. PCT/EP2011/068566, mailed Apr. 11, 2012 (German and English launguage document) (7 pages).

* cited by examiner

*Primary Examiner* — Peter J Bertheaud
*Assistant Examiner* — Dominick L Plakkoottam
(74) *Attorney, Agent, or Firm* — Maginot, Moore & Beck LLP

(57) ABSTRACT

A pump includes an outflow channel configured for discharging fluid out of the pump. The outlet area thereof is formed by a throttle. The throttle includes a spring element configured to change the size of the outlet area of the outflow channel.

10 Claims, 2 Drawing Sheets

PUMP HAVING A THROTTLE

This application is a 35 U.S.C. §371 National Stage Application of PCT/EP2011/068566, filed on Oct. 24, 2011, which claims the benefit of priority to Serial No. DE 10 2010 064 114.6, filed on Dec. 23, 2010 in Germany, the disclosures of which are incorporated herein by reference in their entirety.

BACKGROUND

The disclosure relates to a pump having an outflow channel for discharging fluid out of the pump, the passage area thereof being determined by a throttle.

In the case of pumps, in particular piston pumps with pulsating hydraulic pressure generation, and especially in the case of pumps for use in motor vehicle brake systems, a throttle is often arranged in the outflow channel or discharge channel thereof. The throttle is intended to reduce the effect of pressure pulsations arising in the pump on the downstream hydraulic system and, in particular, to reduce the noise made by the pump. Throttles of this kind with a fixed passage area are known as a low-cost means of noise reduction.

Typical pumps for motor vehicle brake systems comprise a cylinder, in which a piston is movably mounted. As it moves, the piston pumps a fluid in the form of brake fluid into the outflow channel of the pump.

SUMMARY

According to the disclosure, a pump having an outflow channel for discharging fluid out of the pump is provided, the passage area thereof being determined by a throttle. The throttle is designed with a spring element which changes the size of the passage area of the outflow channel.

According to the disclosure, the passage area of the throttle in an outflow channel of a pump is of variable design. By varying or changing the size of the passage area, the throttling effect can be adapted to the operating situation of the pump. The variation in the size of the passage area is provided in a particularly simple way that can be produced at low cost by means of a deflectable spring element. The spring element is subjected to the hydraulic pressure produced by the pump and is pushed back accordingly. As it is pushed back, the spring element simultaneously increases the passage area, reducing the throttling effect. As a result, the throttling effect is reduced at a high delivery rate of the pump, whereas the throttling effect is greater at a low delivery rate.

In the case of known fixed throttle cross sections, in contrast, throttling is excessive at a high delivery rate of the pump and too little at a low delivery rate.

The passage area of the pump is preferably designed with a bypass area that cannot be closed by the spring element. The bypass area forms a passage area or cross-sectional area in the outflow channel, through which flow is always possible. It thereby ensures a minimum outflow from the pump.

The bypass area is preferably formed next to the spring element, along the direction of movement thereof. In this case, the bypass area is preferably designed as a gap, a slit or the like next to the spring element. This gap is not closed and therefore always allows free flow. Moreover, the gap serves to compensate for tolerances in the dimensions of the width of the spring element and the width of the outflow channel. As a result, the mounting of the spring element in the outflow channel is also simpler.

In the pump, the spring element is preferably formed by a leaf spring. The spring element designed in this way is particularly simple to arrange and fixed in position in the outflow channel. Moreover, the leaf spring has only a small installation space requirement.

As an alternative, a diaphragm spring can be chosen as a spring element. A diaphragm spring allows a greater range of variation as regards the size of the passage area when the passage is largely closed and when it is largely open.

The leaf spring is preferably designed and arranged in such a way that it projects in an arc shape into the outflow channel. The fluid flowing through the outflow channel can then flow against the arc shape of the leaf spring in a specifically intended manner, thereby making it possible to keep turbulence formation low. A leaf spring subjected to an incident flow in this way is thus pushed back in a defined manner by the pressure force of the incident flow. In this way, the size of the passage area and hence the throttling effect are varied in a precise manner. It is thus possible to produce a defined flow situation at the spring element, leading to a correspondingly defined throttling behavior of the throttle, which is variable according to the disclosure.

The leaf spring furthermore preferably rests by means of at least one section on a wall of the outflow channel and is of rounded design in this section. The leaf spring designed in this way can be positioned simply by being inserted or placed within the outflow channel. The at least one rounded section reduces the friction of a leaf spring placed against the wall of the outflow channel in this way. Consequently, the bending behavior of the leaf spring is improved when it is forced back and, in the process, deformed by the pressure force of the approaching hydraulic fluid.

At least one offset, by means of which the spring element is positioned in the longitudinal direction of the outflow channel, is preferably formed in the outflow channel. The offset prevents the spring element from shifting along the outflow channel. When designed in this way, the spring element can be positioned in a simple and, at the same time, precise way in the outflow channel.

A pump cap is preferably provided on the pump, acting as a cap element, in particular a disk-shaped cap element, for the cylinder of the pump and having an end face that faces the cylinder. The outflow channel with the spring element arranged therein is formed in the end of the pump cap. An outflow channel formed in this way in the end of a cap element and, in particular, also an offset, formed at the same time in the outflow channel, for the positioning of the spring element can be produced in a particularly simple and low-cost manner. The spring element can simply be inserted or fitted from the side in the outflow channel in the end face. In interaction with another component of the pump, in particular the cylinder, the flow channel formed in this way in the end face can be made to form a closed channel shape or tubular shape.

It is advantageous if the pump is formed along a cylinder axis, and the outflow channel with the spring element arranged therein is oriented radially with respect to the cylinder axis. With the radial flow path of this kind out of the center of the pump toward the outside thereof, a solution which is very space-saving overall and hence optimized in terms of installation space is formed.

The pump described is preferably used in a motor vehicle brake system. The variable throttling effect achieved according to the disclosure is particularly advantageous especially for use in the case of motor vehicle brake systems and the noise reduction that is aimed at there.

BRIEF DESCRIPTION OF THE DRAWINGS

An illustrative embodiment of the solution according to the disclosure is explained in greater detail below with reference to the attached schematic drawings, in which.

DETAILED DESCRIPTION

Figure 1:
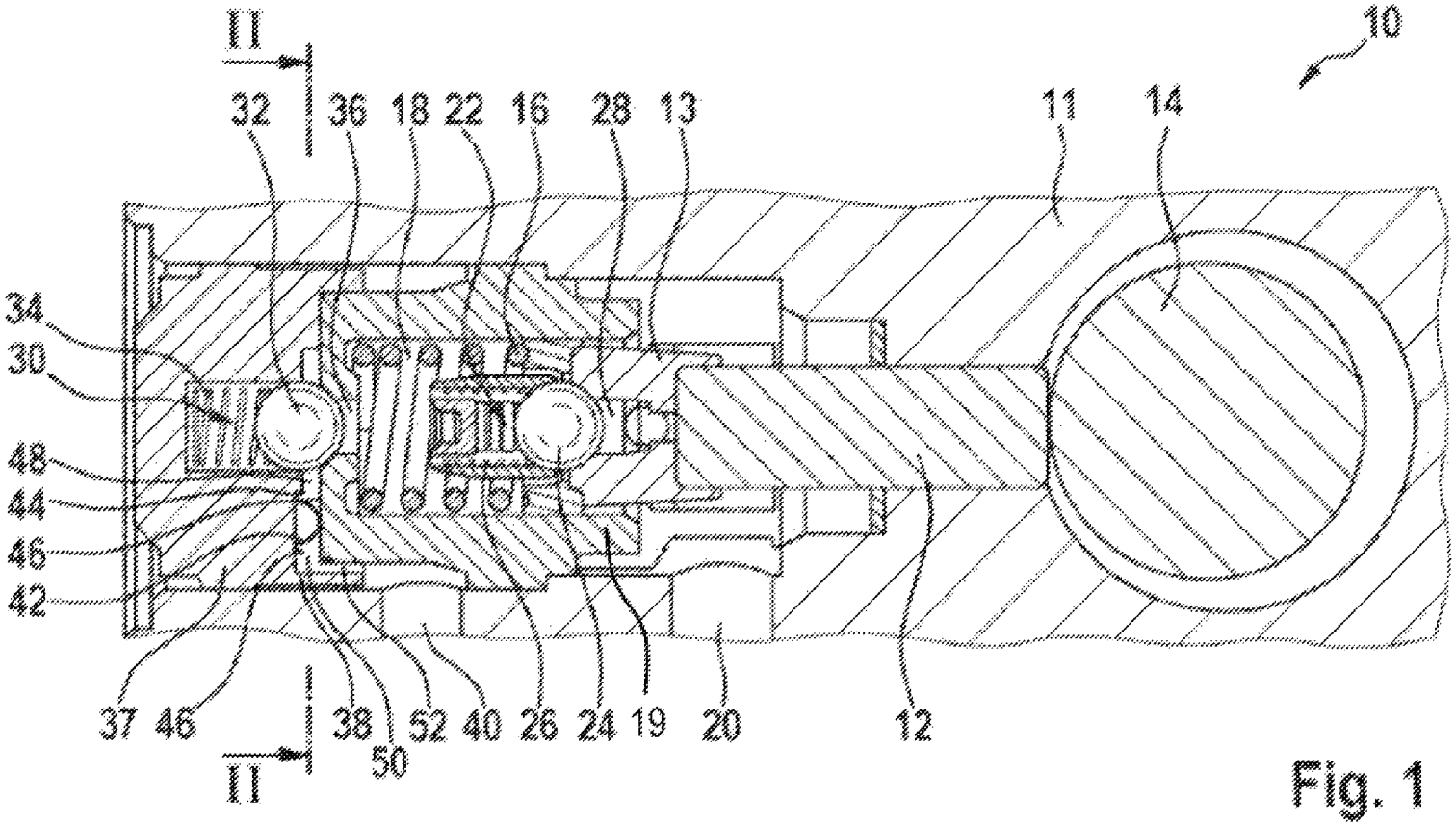
FIG. 1 shows a longitudinal section through a pump according to the disclosure.
Figure 2:
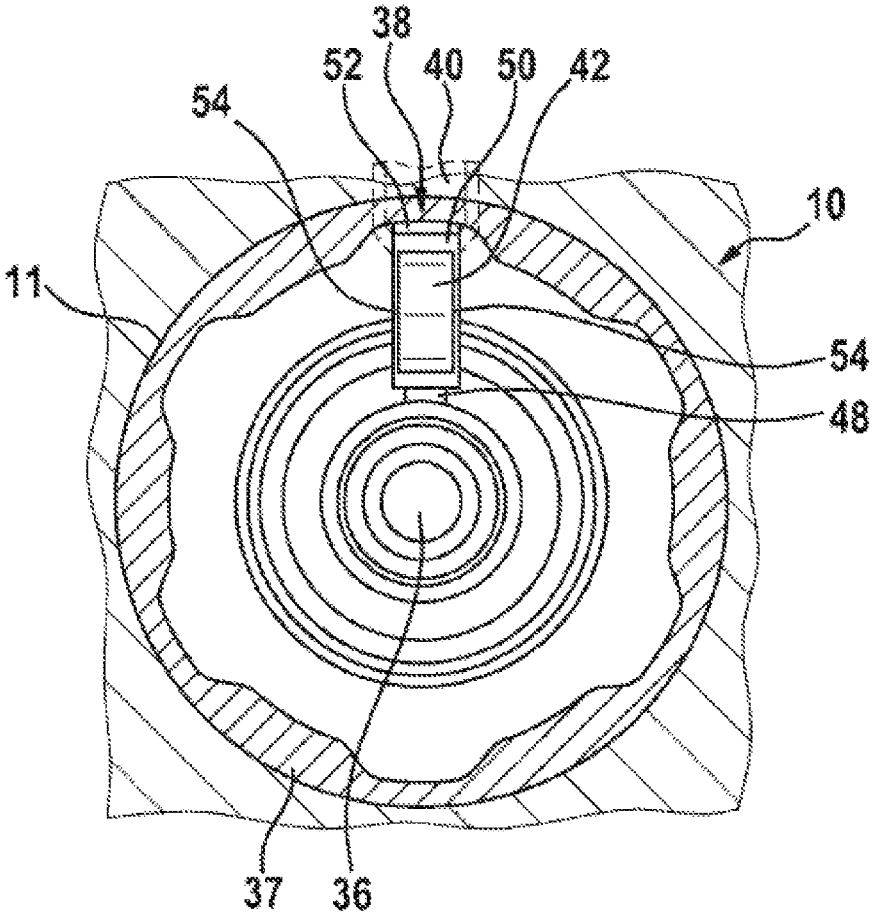
FIG. 2 shows the section II-II according to FIG. 1 on an enlarged scale.

The figures illustrate a pump 10, in which a first piston element 12 and a second piston element 13 are mounted in such a way as to be movable in a substantially block-shaped housing 11. The piston elements 12 and 13 are coupled to one another for the transmission of force, in particular being connected at the ends, and are driven by means of a drive 14 in the form of an eccentric. In this case, the piston element 13 is preloaded toward the drive 14 by a spring 16 in the form of a helical spring. The spring 16 is arranged in a pumping chamber 18, which is surrounded by a cylinder 19. Piston element 13 slides in a fluidtight manner in the cylinder 19.

An inlet 20 is connected fluidically to an inlet opening 28, which is formed centrally in the piston element 13 in relation to the longitudinal axis of the arrangement. This inlet opening 28 is part of an inlet valve 22 and, as such, interacts with a closure element 24 in order selectively to allow brake fluid to flow into the pumping chamber 18. The inlet valve 22 is designed as a nonreturn valve, with the closure element being in the form of a ball which is preloaded toward the inlet opening 28 by means of a spring 26.

There is furthermore a central outlet opening 36 at an end of the cylinder 19 remote from the inlet opening 28. This outlet opening 36 is part of an outlet valve 30 and interacts with a ball-shaped closure element 32. The closure element 32 is preloaded toward the outlet opening 36 by means of a spring 34. The outlet valve 30 is thus likewise designed as a nonreturn valve.

A pump cap 37 is arranged on the end of the cylinder 19, after the outlet opening 28 in the direction of flow of the outflowing brake fluid (and hence outside the pumping chamber 18). The pump cap 37 is mounted on the end of the cylinder 19 and supports the spring 34. The pump cap 37 furthermore makes available sufficient installation space for an accumulator or damper (not shown), if appropriate.

An outflow channel 38 is formed, in particular milled, radially from the pump cap 37, at the end facing the cylinder 19, said outflow channel leading to an outlet 40 in the housing 11. A spring element 42 in the form of a leaf spring acting as a throttle is arranged in the outflow channel 38. The leaf spring is shaped in such a way that, in the rest position thereof, it substantially closes the outflow channel 38 and can be deformed by an incident flow of outflowing brake fluid so as then to provide an enlarged passage area in the outflow channel 38 in comparison with the rest position.

Overall, the leaf spring has an arc-shaped cross section (see FIG. 1) and is provided in the end regions thereof with respective oppositely bent or rounded sections 46. In this arrangement, the sections 46 rest against one of the walls of the outflow channel 38 which are formed by the pump cap 37. The leaf spring is thus bent in a manner similar to a Greek omega (Ω). The bent sections 46 reduce the friction of the leaf spring on the supporting or contact surfaces in the outflow channel 38.

The width (measured in the circumferential direction of the pump cap 37) of the leaf spring is matched to the width of the outflow channel 38 in such a way that a gap 54 remains on both sides of the leaf spring. The gaps 54 thus extend along the direction of movement of the spring element 42 and form a bypass line or a minimum passage area for the outflow channel 38, ensuring a resistance-free minimum outflow from the pump 10. The gaps 54 also serve as a means of compensating for tolerances in respect of the width dimensions mentioned.

An offset 44 is furthermore formed as a kind of step in the outflow channel. A section 46 of the spring element 42 rests against this offset 44, thereby preventing the spring element 42 from being able to shift or slip radially. In particular, this prevents the spring element 42 from being able to shift in the direction of the outlet valve 30 (owing to pressure pulsations in the outflow channel 44). Here, the outflow channel 38 is divided from the inside outward into a first radial subsection 48, a second radial subsection 50 and a third, axial subsection 52. The offset 44 is formed in subsection 48, and the spring element 42 is formed in subsection 50. The transition from subsection 50 to subsection 52 is of L-shaped configuration, thereby ensuring that the spring element 42 is restrained in the direction toward the outlet 40. Subsection 48 is of slightly longer configuration than the leaf spring, thus allowing the latter sufficient space for the bending movement thereof.

The operation of the variable throttle provided by the spring element 42 is explained below: when there is a pumping operation triggered by the drive 14, which pushes the coupled piston elements 12 and 13 into the pumping chamber 18, fluid is forced under pressure into the outflow channel 38 through the outlet valve 30.

As far as possible, the fluid can flow through the outflow channel 38 through the gaps 54. Moreover, a backpressure builds up ahead of the spring element 42, leading to the spring element 42 being moved out of the rest position thereof into a deformed position. In this deformed position, the shape of the spring element 42 is less arched, i.e. it is bent back. It then no longer blocks the outflow channel 38 to a substantial degree but exposes an enlarged passage area in said channel, through which fluid can pass to the outlet 40.

The spring element 42 is thus deformed as long as a relatively large quantity of fluid is supplied from subsection 48 of the outflow channel 38. The deformation begins only above a certain pressure value or above a certain force exerted by the fluid on the spring element 42. The flow cross section through the outflow channel 38, which was previously largely closed, is increased. The throttle thus regulates the flow of fluid through the outflow channel 38 in accordance with the delivery rate of the pump 10.

The advantageous aspect of this embodiment is that the spring element 42 can be produced at low cost as a simple bent sheet-metal part by means of stamping. Moreover, only a small amount of space is required for the spring element 42. In principle, just one outflow channel 38 with an associated variable throttle is necessary. However, it is also possible for a plurality of such outflow channels to be provided, in particular a plurality of outflow channels distributed around the circumference of the pump cap 37.

The invention claimed is:

1. A pump, comprising:

a housing;

a cylinder member mounted within the housing, the cylinder member defining a pumping chamber in which a piston is slidably received and an outlet opening through which fluid flows out of the pumping chamber;

an outlet valve that controls fluid flow out of the outlet opening;

an outflow channel located after the outlet valve in the direction of outflowing fluid from the pumping chamber, the outflow channel connecting the outlet opening to a pump outlet defined in the housing, wherein the outflow channel has a passage area defined by a throttle, and wherein the throttle includes a spring element that is located within the outflow passage and is configured to change the size of the passage area of the outflow channel by deformation of the spring element.

2. The pump as claimed in claim 1, wherein the passage area has a bypass area that cannot be closed by the spring element.

3. The pump as claimed in claim 2, wherein the bypass area is formed next to the spring element along the direction of movement thereof.

4. The pump as claimed in claim 1, wherein the spring element is formed by a leaf spring.

5. The pump as claimed in claim 4, wherein the leaf spring projects in an arc shape into the outflow channel.

6. The pump as claimed in claim 4, wherein the leaf spring rests on a wall of the outflow channel by at least one section of the leaf spring that is of rounded design.

7. The pump as claimed in claim 1, wherein at least one offset is formed in the outflow channel, the at least one offset being configured to position the spring element in the longitudinal direction of the outflow channel.

8. The pump as claimed in claim 1, wherein the cylinder member is a pump cap, the pump cap having an end into which the outflow channel with the spring element arranged therein is formed.

9. The pump as claimed in claim 1, wherein the pump defines a longitudinal axis, and the outflow channel with the spring element arranged therein is oriented radially with respect to the longitudinal axis.

10. The pump as claimed in claim 1, wherein the pump is used in a motor vehicle brake system.

* * * * *